US011643699B2

(12) United States Patent
Nishimura et al.

(10) Patent No.: US 11,643,699 B2
(45) Date of Patent: May 9, 2023

(54) FERRITIC STAINLESS STEEL SHEET AND PRODUCTION METHOD THEREOF, AND FERRITIC STAINLESS MEMBER

(71) Applicant: NIPPON STEEL STAINLESS STEEL CORPORATION, Tokyo (JP)

(72) Inventors: Koh Nishimura, Tokyo (JP); Yoshiharu Inoue, Tokyo (JP); Junichi Hamada, Tokyo (JP)

(73) Assignee: NIPPON STEEL STAINLESS STEEL CORPORATION, Tokyo (JP)

( * ) Notice: Subject to any disclaimer, the term of this patent is extended or adjusted under 35 U.S.C. 154(b) by 289 days.

(21) Appl. No.: 17/041,201

(22) PCT Filed: Mar. 29, 2019

(86) PCT No.: PCT/JP2019/014318
§ 371 (c)(1),
(2) Date: Sep. 24, 2020

(87) PCT Pub. No.: WO2019/189872
PCT Pub. Date: Oct. 3, 2019

(65) Prior Publication Data

US 2021/0032718 A1 Feb. 4, 2021

(30) Foreign Application Priority Data

Mar. 30, 2018 (JP) ..... JP2018-068221

(51) Int. Cl.

| | |
|---|---|
| ***C21D 9/46*** | (2006.01) |
| ***C21D 8/02*** | (2006.01) |
| ***C22C 38/00*** | (2006.01) |
| ***C22C 38/08*** | (2006.01) |
| ***C22C 38/12*** | (2006.01) |
| ***C23G 1/00*** | (2006.01) |

(52) U.S. Cl.
CPC ..... *C21D 9/46* (2013.01); *C21D 8/0226* (2013.01); *C21D 8/0236* (2013.01); *C21D 8/0273* (2013.01); *C22C 38/001* (2013.01); *C22C 38/002* (2013.01); *C22C 38/008* (2013.01); *C22C 38/08* (2013.01); *C22C 38/12* (2013.01); *C23G 1/00* (2013.01); *C21D 2211/005* (2013.01)

(58) Field of Classification Search
CPC ..... C21D 9/46
See application file for complete search history.

(56) References Cited

U.S. PATENT DOCUMENTS

2015/0020933 A1* 1/2015 Hamada ..... C22C 38/28 148/610
2021/0108283 A1* 4/2021 Hamada ..... C22C 38/44

FOREIGN PATENT DOCUMENTS

JP 2000-265215 A 9/2000
JP 2003-138349 A 5/2003
JP 2005-105347 A 4/2005
WO WO-2016068139 A1 * 5/2016 ..... C21D 6/004

* cited by examiner

*Primary Examiner* — Jophy S. Koshy
(74) *Attorney, Agent, or Firm* — Birch, Stewart, Kolasch & Birch, LLP

(57) ABSTRACT

A ferritic stainless steel sheet is provided that has a chemical composition consisting of, in mass %, C: 0.001 to 0.020%, Si: 0.02 to 1.50%, Mn: 0.02 to 1.50%, P: 0.01 to 0.05%, S: 0.0001 to 0.01%, Cr: 10.0 to 25.0%, Ti: 0.01 to 0.30%, N: 0.001 to 0.030%, and optional elements, with the balance being Fe and unavoidable impurities, wherein: a grain size number is 6 or more; the ferritic stainless steel sheet satisfies the formulas [A+B≥12.0/t], [X+Y≥12.0/(t−0.3)] and [(X+Y)−(A+B)≤5.0] with respect to crystal orientation intensities of a ferrite phase obtained by X-ray diffraction; and the sheet thickness is 1.0 mm or more.

14 Claims, 2 Drawing Sheets

FERRITIC STAINLESS STEEL SHEET AND PRODUCTION METHOD THEREOF, AND FERRITIC STAINLESS MEMBER

TECHNICAL FIELD

The present invention relates to a ferritic stainless steel sheet, a method for producing the ferritic stainless steel sheet, and a ferritic stainless member.

BACKGROUND ART

Ferritic stainless steel sheets are used in a wide range of fields such as for household electrical appliances, kitchen instruments and electronic devices. In recent years, the application of stainless steel sheets as raw material to be used for exhaust pipes, fuel tanks and pipes of automobiles and motorcycles is being studied.

The exhaust system components are required to have corrosion resistance and heat resistance in an exhaust environment and a fuel environment. Further, the components are formed by subjecting a steel sheet to press working, or making a steel sheet into a pipe of a predetermined size (diameter) and thereafter forming into the desired shape. Therefore, a blank steel sheet to be used for these components is required to have high workability.

Furthermore, in recent years the component configurations have become complicated in order to meet environmental regulations and also achieve a reduction in weight, and in accompaniment therewith the shapes of the components themselves are also becoming complicated. While the above-mentioned material characteristics of corrosion resistance and heat resistance are naturally required for exhaust system members, the cost is also important. Further, various measures for reducing the number of forming and welding processes performed when forming components are being examined from the viewpoint of reducing the cost of the components. Integral forming of components may be mentioned as one example of such approaches. In the conventional technique, a method has been used in which a steel sheet or a pipe is subjected to a forming process, and thereafter the relevant component is joined by welding to another component.

In contrast, Integral forming refers to a method in which a steel sheet or a pipe is integrally formed in a combination of a variety of processes (deep drawing, bulging, bending, expansion or the like) on parts where are conventionally joined by welding. By producing components by Integral forming, a welding process can be omitted and the cost can be reduced. On the other hand, a stainless steel sheet to be used for the members is required to have even higher workability.

In this connection, a stainless steel sheet for the exhaust system components is required to have various kinds of workability. For example, in press working, the workability with respect to deep drawability and hole expandability is an important characteristic. Further, in Integral forming described above, workability with respect to bending, bulging, and expandability is also required in some cases.

Among different kinds of stainless steel sheets, ferritic stainless steel sheets are less expensive in comparison to austenitic stainless steel sheets. Therefore, when considered in terms of cost, it can be said that ferritic stainless steel sheets are suitable as steel sheets to be used for the members. However, because ferritic stainless steel sheets are inferior in formability to austenitic stainless steel sheets, in some cases the usages and component shapes to which ferritic stainless steel sheets are applicable are limited. For this reason, in the case of using a ferritic stainless steel sheet as the members, the regions where the ferritic stainless steel sheet can be used have been limited.

Due to the foregoing circumstances, various techniques have been devised to solve the problem regarding workability with regard to heat-resistant ferritic stainless steel sheets for use in exhaust system components.

Patent Document 1 discloses a steel sheet in which workability is improved by controlling conditions such as the annealing temperature and time period after hot rolling, as well as a method for producing the steel sheet. Patent Document 1 discloses a steel sheet in which the mean r-value is 1.2 or more. The method of producing the steel sheet is a method that controls the crystal orientation of a steel sheet by performing microstructure control of the steel sheet when subjecting a hot-rolled steel sheet to an annealing process. As a result, a steel sheet which has high workability can be obtained.

Patent Document 2 discloses a steel sheet in which workability is improved by omitting annealing of a hot-rolled steel sheet, as well as a method for producing the steel sheet. Patent Document 2 discloses a steel sheet having a thickness of 0.7 mm for which the mean r-value is approximately 1.3. The method for producing the steel is a method in which the rolling reduction, the coefficient of friction between the rolls and the steel sheet, and the finish rolling mill exit side temperature are controlled during a hot rolling process and finish rolling. In addition, hot-rolled-sheet annealing is omitted. By this means, the number of processes is reduced, and a steel sheet having further improved workability can be obtained.

Patent Document 3 discloses a steel sheet in which workability is improved by controlling hot rolling conditions and performing a two-step cold rolling and annealing process, as well as a method for producing the steel sheet. Patent Document 3 discloses a steel sheet having a thickness of 0.8 mm for which the mean r-value is at maximum approximately 2.3.

Further, the method for producing the steel controls the temperature during rough rolling and finish rolling of the hot rolling as well as the rolling reduction, and combines intermediate cold rolling and intermediate annealing within a range of 650 to 900° C. By this means, the microstructure prior to the finish cold rolling is controlled and a steel sheet having high workability is obtained.

LIST OF PRIOR ART DOCUMENTS

Patent Document

Patent Document 1: JP2005-105347A
Patent Document 2: JP2000-265215A
Patent Document 3: JP2003-138349A

SUMMARY OF INVENTION

Technical Problem

Among the different kinds of workability, the deep drawability characteristics, for which the Lankford value (hereunder, described as "r-value") serves as an index, are improved by controlling the crystal orientation. To improve the r-value, it is effective to cause recrystallized grain for which the rolling plane and the {111} plane become parallel (hereunder, also referred to as "{111} grain") to develop through the entire thickness of the steel sheet by increasing the rolling reduction during rolling and making the annealing temperature a high temperature.

The sheet thickness of raw material to be used for an exhaust system component such as a muffler is 1.0 mm or more in some cases. In the case of the steel sheet having a thickness of 1.0 mm or more, the rolling reduction inevitably decreases. Therefore, a case is conceivable in which the {111} grains, which are effective for improving deep drawability, will not be adequately formed by only increasing the rolling reduction during rolling, and the texture will not develop.

In the steel types of Patent Documents 1 to 3, in a case where Nb is added and the sheet thickness is large, cases are conceivable in which the {111} grains will not adequately develop due to an effect of Nb that delays recrystallization.

Specifically, in the production process described in Patent Document 1, when hot-rolled-sheet annealing is performed, working strain that is imparted during hot rolling disappears. Therefore, it is considered that the amount of dislocations that serve as the driving force of recrystallization decreases, and the {111} grains do not adequately develop. In addition, the increase in the number of processes significantly reduces productivity.

A thin steel sheet with a thickness of 1.0 mm or less is assumed as the steel sheet disclosed in Patent Document 2. Further, even when the production method disclosed in Patent Document 2 is used, it is conceivable that the r-value will be insufficient in the case of a steel sheet with a thickness of 1.0 mm or more. Furthermore, with respect to Patent Document 3, in the case of a steel sheet having a thickness of more than 1.0 mm that is assumed in the present application, it is conceivable that even when two-step cold rolling and annealing is performed, the total rolling reduction ratio will be insufficient and the {111} grains will not adequately develop. In addition, the increase in the number of processes significantly reduces productivity.

Further, performing hot-rolled-sheet annealing, intermediate annealing and/or heat treatment to cause the steel sheet microstructure to recrystallize during the course of production promotes randomization of the crystal orientation in some cases, as in Patent Document 1 or 3. When these steel sheets are subjected to cold rolling and annealing, the in-plane anisotropy (Δr) of the steel sheets is increased, which in some cases leads to a defect such as cracks when forming the steel sheet such as when performing hole expansion.

An objective of the present invention is to solve the problems described above, and provide a ferritic stainless steel sheet for an exhaust component which has a sheet thickness of 1.0 mm or more which is excellent in workability, particularly deep drawability, as well as a method for producing the ferritic stainless steel sheet, and to also provide a ferritic stainless member for an exhaust system component.

Solution to Problem

The present invention has been made to solve the problems described above, and the gist of the present invention is a ferritic stainless steel sheet, a method for producing the ferritic stainless steel sheet, and a ferritic stainless member for an exhaust system component that are described hereunder.

(1) A ferritic stainless steel sheet having a chemical composition consisting of, in mass %, C: 0.001 to 0.020%,
Si: 0.02 to 1.50%,
Mn: 0.02 to 1.50%,
P: 0.01 to 0.05%,
S: 0.0001 to 0.01%,
Cr: 10.0 to 25.0%,
Ti: 0.01 to 0.30%,
N: 0.001 to 0.030%,
Nb: 0 to less than 0.10%,
Sn: 0 to 0.500%,
Mg: 0 to 0.0100%,
B: 0 to 0.0050%,
V: 0 to 1.0%,
Mo: 0 to 3.0%,
W: 0 to 3.0%,
Al: 0 to 0.5%,
Cu: 0 to 2.0%,
Zr: 0 to 0.30%,
Co: 0 to 0.50%,
Sb: 0 to 0.50%,
REM: 0 to 0.05%,
Ni: 0 to 2.0%,
Ca: 0 to 0.0030%,
Ta: 0 to 0.10%,
Ga: 0 to 0.1%, and
the balance: Fe and unavoidable impurities,
wherein:
a grain size number is 6.0 or more,
the ferritic stainless steel sheet satisfies formula (i), formula (ii) and formula (iii) described hereunder with respect to crystal orientation intensities of a ferrite phase obtained by X-ray diffraction,
and a sheet thickness is 1.0 mm or more;

$$A+B \geq 12.0/t \quad \text{(i)}$$

$$X+Y \geq 12.0/(t-0.3) \quad \text{(ii)}$$

$$(X+Y)-(A+B) \leq 5.0 \quad \text{(iii)}$$

where, each symbol in the above formulas is defined as follows:

t: sheet thickness (mm)
A: a {111}<112> crystal orientation intensity at a center portion of sheet thickness
B: a {111}<112> crystal orientation intensity at a ¼ portion of the sheet thickness
X: a {322}<236> crystal orientation intensity at a center portion of sheet thickness
Y: a {322}<236> crystal orientation intensity at a ¼ portion of the sheet thickness.

(2) The ferritic stainless steel sheet according to (1) above, wherein a mean r-value calculated by formula (iv) described hereunder and a minimum r-value satisfy formula (v) and formula (vi) described hereunder:

$$r_m=(r_0+2r_{45}+r_{90})/4 \quad \text{(iv)}$$

$$r_m \geq 2.0/t \quad \text{(v)}$$

$$r_{min} \geq 2.0/(t+0.3) \quad \text{(vi)}$$

where, each symbol in the above formulas is defined as follows:

$r_m$: mean r-value
$r_{min}$: minimum r-value
t: sheet thickness (mm)
$r_0$: r-value in a rolling direction
$r_{45}$: r-value in 45° direction with respect to the rolling direction
$r_{90}$: r-value in 90° direction with respect to the rolling direction.

(3) The ferritic stainless steel sheet according to (1) or (2) above, wherein the chemical composition contains, in mass %, Nb: more than 0.005% to less than 0.10%.

(4) The ferritic stainless steel sheet according to any one of (1) to (3) above, wherein the chemical composition contains, in mass %, one or more elements selected from:

Sn: 0.01 to 0.500%,

Mg: 0.0002 to 0.0100%,

B: 0.0002 to 0.0050%,

V: 0.05 to 1.0%,

Mo: 0.2 to 3.0%, and

W: 0.1 to 3.0%.

(5) The ferritic stainless steel sheet according to any one of (1) to (4) above, wherein the chemical composition contains, in mass %, one or more elements selected from:

Al: 0.003 to 0.5%,

Cu: 0.1 to 2.0%,

Zr: 0.05 to 0.30%,

Co: 0.05 to 0.50%,

Sb: 0.01 to 0.50%, and

REM: 0.001 to 0.05%.

(6) The ferritic stainless steel sheet according to any one of (1) to (5) above, wherein the chemical composition contains, in mass %, one or more elements selected from:

Ni: 0.1 to 2.0%,

Ca: 0.0001 to 0.0030%,

Ta: 0.01 to 0.10%, and

Ga: 0.0002 to 0.1%.

(7) The ferritic stainless steel sheet according to any one of (1) to (6) above, wherein the ferritic stainless steel sheet is used for an exhaust system component.

(8) A ferritic stainless member for an exhaust system component of an automobile or a motorcycle, comprising a ferritic stainless steel sheet according to any one of (1) to (6) above.

(9) A method for producing a ferritic stainless steel sheet, comprising executing in sequence:

(a) a process of heating a slab having a chemical composition according to any one of (1) to (6) above, and hot-rolling the slab to form a hot-rolled steel sheet;

(b) a hot-rolled steel sheet pickling process of pickling the hot-rolled steel sheet without subjecting the hot-rolled steel sheet to annealing, to obtain a pickled steel sheet;

(c) a cold rolling process of using a rolling mill having a roll diameter of 400 mm or more to subject the pickled steel sheet to cold rolling with a rolling reduction of 60% or more to obtain a cold-rolled steel sheet; and (d) a process of annealing the cold-rolled steel sheet at an annealing temperature Tf (° C.) that satisfies formula (vii) described hereunder;

wherein:

in the process of (d), an average heating rate until reaching the annealing temperature Tf (° C.) is:

set to 15° C./s or more in a temperature region from a starting temperature of heating to a starting temperature of recrystallization Ts (° C.) calculated by formula (viii) described hereunder, and set to 10° C./s or less in a temperature region from the starting temperature of recrystallization Ts (° C.) to the annealing temperature Tf (° C.);

$$800 \leq Tf(^\circ\,C.) \leq 950 \quad \text{(vii)}$$

$$Ts(^\circ\,C.) = 700 + (1 - X/100) \times 130 \quad \text{(viii)}$$

where, a symbol in the above formulas is defined as follows:

X: rolling reduction in cold rolling (%).

Advantageous Effects of Invention

According to the present invention, a ferritic stainless steel sheet for an exhaust component which has a sheet thickness of 1.0 mm or more which is excellent in workability, particularly deep drawability, as well as a method for producing the ferritic stainless steel sheet, and also a ferritic stainless member for an exhaust system component can be provided.

DESCRIPTION OF EMBODIMENTS

Figure 1:
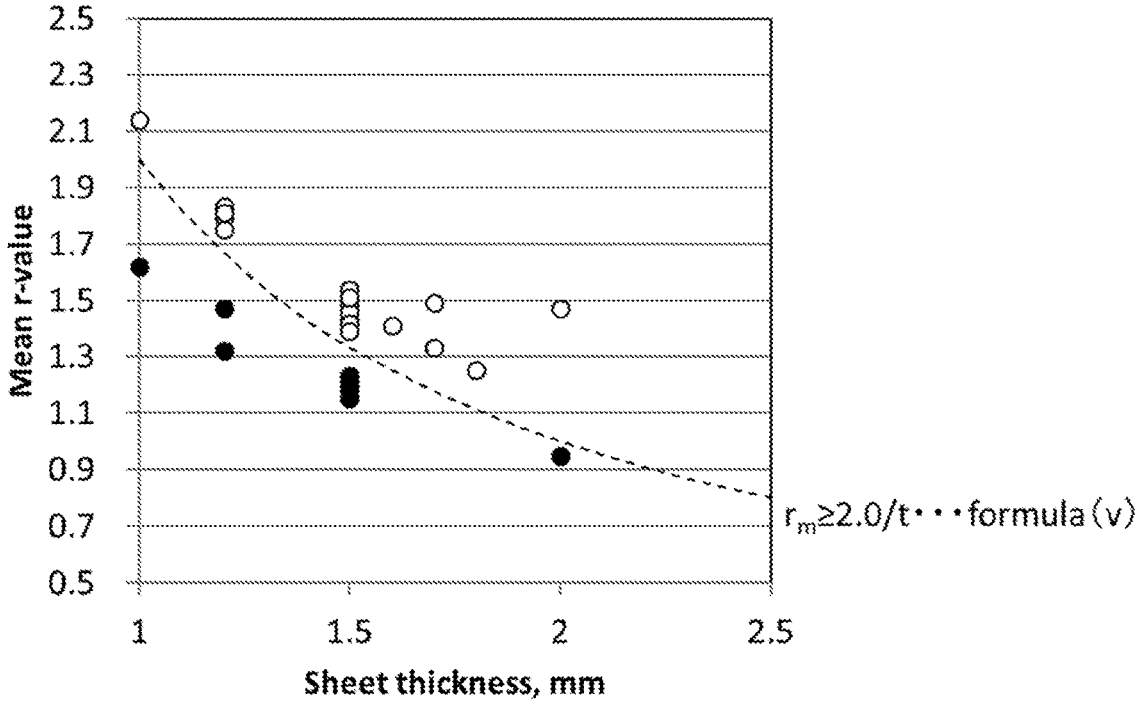
FIG. 1 is a view illustrating the relation between the sheet thickness and the mean r-value of steel sheets.

To solve the aforementioned problems, in relation to the workability of ferritic stainless steel sheets, the present inventors conducted detailed studies regarding composition, the microstructure during the course of production, and the crystal orientation formation. As a result, the present inventors obtained the findings described in (A) and (B) hereunder.

(A) In a heat-resistant ferritic stainless steel sheet having a sheet thickness of 1.0 mm or more, in order to obtain a target mean r-value, it is necessary to appropriately control the components of the steel sheet and the production conditions in each of the production processes, and cause texture of a specific orientation to develop.

(B) As a specific orientation, when texture with a {111}<112> orientation develops, the r-values ($r_0$, $r_{45}$, $r_{90}$) for respective directions with respect to the rolling direction increase, particularly the values of $r_0$ and $r_{90}$, and a high mean r-value is obtained. Further, in addition to the orientation, when texture with a {322}<236> orientation develops, although $r_0$ decreases, the values of $r_{45}$ and $r_{90}$ increase. In particular, developing a texture with a {322}<236> orientation is effective for improving $r_{45}$ which it is difficult to improve by simply developing a {111} texture alone.

The present invention has been made based on the findings described above. The respective requirements of the present invention are described in detail hereunder.

1. Chemical Composition

The reasons for limiting each element are as follows. Note that, the symbol "%" with respect to a content in the following description means "mass percent".

C: 0.001 to 0.020%

C deteriorates the toughness, corrosion resistance and oxidation resistance. In addition, C that dissolved in the matrix inhibits development of texture with a {111}<112> orientation and texture with a {322}<236> orientation. Therefore, the lower the content of C is, the better, and hence the content of C is set to 0.020% or less. However, excessive reduction of C will lead to an increase in the refining cost, and therefore the content of C is set to 0.001% or more. In addition, in consideration of the production cost and corrosion resistance, the content of C is preferably 0.002% or more, and preferably is 0.010% or less.

Si: 0.02 to 1.50%

In addition to being a deoxidizing element, Si is also an element that increases oxidation resistance and high temperature strength. Further, by containing Si, the amount of oxygen in the steel decreases and it becomes easy for texture with a {111}<112> orientation and texture with a {322}<236> orientation to develop. Therefore, the content of Si is set to 0.02% or more. On the other hand, if the content of Si is more than 1.50%, the steel sheet noticeably hardens, and bendability at a time of pipe working deteriorates.

Therefore, the content of Si is set to 1.50% or less. Note that, in order to cause the textures to markedly develop, the content of Si is preferably more than 0.30%, and more preferably is 0.80% or more. Further, in consideration of the toughness and pickling properties during steel sheet production, the content of Si is preferably 1.20% or less. More preferably, the content of Si is 1.00% or less.

Mn: 0.02 to 1.50%

Mn forms $MnCr_2O_4$ or MnO at high temperatures, and improves scale adhesion. Therefore, the content of Mn is set to 0.02% or more. On the other hand, if the content of Mn is more than 1.50%, the amount of oxides increases and breakaway oxidation is liable to occur. Further, Mn forms a compound with S and thereby inhibits development of texture with a {111}<112> orientation and texture with a {322}<236> orientation. Therefore, the content of Mn is set to 1.50% or less. Further, in consideration of the toughness and pickling properties during steel sheet production, the content of Mn is preferably 1.00% or less. In addition, in consideration of flat cracks that are attributable to oxides at pipe weld zones, the content of Mn is more preferably 0.30% or less.

P: 0.01 to 0.05%

P is a solid-solution strengthening element, similarly to Si, and therefore, from the viewpoint of material quality and toughness, the lower the content of P is, the better. Further, P that dissolved in the matrix inhibits development of texture with a {111}<112> orientation and texture with a {322}<236> orientation, and therefore the content of P is set to 0.05% or less.

On the other hand, excessive reduction of P will lead to an increase in the refining cost, and therefore the content of P is set to 0.01% or more. In addition, in consideration of the production cost and oxidation resistance, the content of P is preferably 0.015% or more, and preferably is 0.03% or less.

S: 0.0001 to 0.01%

From the viewpoint of material quality, corrosion resistance and oxidation resistance, the lower the content of S is, the better. In particular, if S is excessively contained, S will form compounds with Ti or Mn which will cause the occurrence of cracks that originate from inclusions when performing pipe bending. In addition, the presence of these compounds will inhibit the development of texture with a {111}<112> orientation and texture with a {322}<236> orientation.

Therefore, the content of S is set to 0.01% or less. On the other hand, excessive reduction of S will lead to an increase in the refining cost, and therefore the content of S is set to 0.0001% or more. In addition, in consideration of the production cost and corrosion resistance, the content of S is preferably 0.0005% or more, and preferably is 0.0050% or less.

Cr: 10.0 to 25.0%

Cr is a necessary element for securing high temperature strength and oxidation resistance which are the most important characteristics required of exhaust components. Therefore, the content of Cr is set to 10.0% or more. On the other hand, if the content of Cr is more than 25.0%, the toughness will decrease and the producibility will deteriorate, and in particular, will give rise to embrittlement cracking at pipe weld zones and inferior bendability.

In addition, an excessive content of dissolved Cr will inhibit the development of texture with a {111}<112> orientation and texture with a {322}<236> orientation. Therefore, the content of Cr is set to 25.0% or less. Further, from the viewpoint of the toughness of a hot-rolled sheet during steel sheet production, the content of Cr is preferably 10.0% or more, and preferably is 20.0% or less, and more preferably is 18.0% or less. In addition, from the viewpoint of the production cost, the content of Cr is preferably less than 14.0%.

Ti: 0.01 to 0.30%

Ti combines with C, N, and S and has an effect that improves the corrosion resistance, intergranular corrosion resistance and deep drawability. Further, Ti nitrides act as nuclei during casting of a slab, and increase the equiaxial crystal ratio and cause texture with a {111} orientation to develop in the product sheet and promote an increase in the r-value.

An action which fixes C and N of Ti occurs when the content of Ti is 0.01% or more. Therefore, the content of Ti is set to 0.01% or more. However, if the content of Ti is more than 0.30%, dissolved Ti will cause the steel sheet to harden, and in addition the toughness will deteriorate. Therefore, the content of Ti is set to 0.30% or less. In addition, in consideration of the production cost and the like, the content of Ti is preferably 0.05% or more, and is preferably 0.25% or less.

N: 0.001 to 0.030%

Similarly to C, N causes the low-temperature toughness, workability and oxidation resistance to deteriorate. In addition, N that dissolved in the matrix inhibits development of texture with a {111}<112> orientation and texture with a {322}<236> orientation, and therefore the lower the content of N is, the better. Hence, the content of N is set to 0.030% or less. On the other hand, excessive reduction of N will lead to an increase in the refining cost. Therefore, the content of N is set to 0.001% or more. In addition, in consideration of the production cost and toughness, the content of N is preferably 0.005% or more, and preferably is 0.020% or less.

Apart from the respective components described above, as necessary the present invention may also contain one or more groups of components among the following A group, B group, C group and D group. The element in A group is an element that improves corrosion resistance and workability. The elements classified into B group are elements that influence texture with a {111} orientation. The elements classified into C group are elements that improve high-temperature characteristics such as high temperature strength and oxidation resistance. The elements classified into D group are elements that improve toughness and corrosion resistance and the like.

A Group Element

Nb: 0 to Less than 0.10%

Similarly to Ti, Nb combines with C, N, and S and improves corrosion resistance, intergranular corrosion resistance, and deep drawability. Further, because the solid-solution strengthening ability and precipitation strengthening ability of Nb in a high temperature region is high, Nb improves high temperature strength and a thermal fatigue property. Therefore, Nb may be contained as necessary. However, an excessive content of Nb will markedly delay the progress of recrystallization and will inhibit the development of {111} texture. Therefore, the content of Nb is set to less than 0.10%. Further, in consideration of the influence on recrystallization, the content of Nb is preferably 0.05% or less. On the other hand, to obtain the aforementioned effects, the content of Nb is preferably more than 0.005%.

B Group Elements

Sn: 0 to 0.500%

Sn causes compositional supercooling to occur during slab casting, and causes the equiaxial crystal ratio to increase. By this means, texture with a {111} orientation is caused to develop in a product sheet, and improvement of the r-value and pipe expandability is promoted. Therefore, Sn may be contained as necessary. However, if the content of Sn is more than 0.500%, excessive segregation will occur, and the low-temperature toughness of pipe weld zones will decrease. Therefore, the content of Sn is set to 0.500% or less. Further, taking into consideration the high-temperature characteristics, the production cost, and toughness, the content of Sn is preferably 0.300% or less. On the other hand, to obtain the aforementioned effects, the content of Sn is preferably 0.01% or more.

Mg: 0 to 0.0100%

Similarly to Al, Mg forms Mg oxides in molten steel and acts as a deoxidizer. In addition, Mg oxides in which Mg finely crystallized act as nuclei and cause the equiaxial crystal ratio of the slab to increase, and stimulate precipitation of Nb- and Ti-based fine precipitates in a subsequent process. Specifically, when the precipitates finely precipitate in a hot rolling process, the precipitates serve as recrystallization nuclei in the hot rolling process and a subsequent annealing process of the hot-rolled sheet. As a result, an extremely fine recrystallized microstructure is obtained. The recrystallized microstructure contributes to development of texture with a {111} orientation, and also contributes to improving the toughness. Therefore, Mg may be contained as necessary.

However, an excessive content of Mg will cause deterioration in the oxidation resistance and a decrease in weldability and the like. Therefore, the content of Mg is set to 0.0100% or less. On the other hand, to obtain the aforementioned effects, the content of Mg is preferably 0.0002% or more. In addition, in consideration of the refining cost, the content of Mg is more preferably 0.0003% or more, and preferably is 0.0020% or less.

B: 0 to 0.0050%

B segregates at grain boundaries and thus has the effect of improving grain boundary strength, secondary workability, low-temperature toughness, and high temperature strength in a medium temperature region. Therefore, B may be contained as necessary. However, if the content of B is more than 0.0050%, B compounds such as $Cr_2B$ will be formed, which cause intergranular corrosion properties and fatigue properties to deteriorate. In addition, B inhibits the development of texture with a {111} orientation, and causes the r-value to decrease. Therefore, the content of B is set to 0.0050% or less. On the other hand, to obtain the aforementioned effect, the content of B is preferably 0.0002% or more. In addition, in consideration of weldability and producibility, the content of B is preferably 0.0003% or more, and preferably is 0.0010% or less.

V: 0 to 1.0%

V combines with C or N and improves corrosion resistance and heat resistance. Therefore, V may be contained as necessary. However, if the content of V is more than 1.0%, coarse carbo-nitrides will be formed and the toughness will decrease, and development of texture with a {111} orientation will also be inhibited. Therefore, the content of V is set to 1.0% or less. In addition, in consideration of the production cost and producibility, the content of V is preferably 0.2% or less. On the other hand, to obtain the aforementioned effect, the content of V is preferably 0.05% or more.

Mo: 0 to 3.0%

Mo is an element that improves corrosion resistance, and in particular, in the case of a tube blank having a crevice structure, is an element that suppresses crevice corrosion. Therefore, Mo may be contained as necessary. However, if the content of Mo is more than 3.0%, the formability will markedly deteriorate and producibility will decrease. Furthermore, Mo inhibits the development of texture with a {111} orientation. Therefore, the content of Mo is set to 3.0% or less. On the other hand, to obtain the aforementioned effect, the content of Mo is preferably 0.2% or more. In addition, in consideration of the production cost, the productivity, and causing texture with a {111} orientation to sharply develop, the content of Mo is preferably 0.4% or more, and preferably is 2.0% or less.

W: 0 to 3.0%

W increases the high temperature strength, and hence may be contained as necessary. However, an excessive content of W will cause deterioration in toughness and a decrease in elongation. Further, W increases the formed amount of Laves phase that is an intermetallic compound phase, and inhibits the development of texture with a {111} orientation and decreases the r-value. Therefore, the content of W is set to 3.0% or less. In addition, in consideration of the production cost and producibility, the content of W is preferably 2.0% or less. On the other hand, to obtain the actions, the content of W is preferably 0.1% or more.

C Group Elements

Al: 0 to 0.5%

Al is used as a deoxidizing element in some cases, and also improves high temperature strength and oxidation resistance, and therefore may be contained as necessary. Further, Al acts as a precipitation site of TiN and Laves phase, and refines precipitates and improves low-temperature toughness. However, if the content of Al is more than 0.5%, Al will cause a decrease in elongation and deterioration in weldability and surface quality. It will also cause formation of coarse Al oxides and reduce the low-temperature toughness. Therefore, the content of Al is set to 0.5% or less. On the other hand, to obtain the aforementioned effects, the content of Al is preferably 0.003% or more. In addition, in consideration of the refining costs, the content of Al is preferably 0.01% or more, and preferably is 0.1% or less.

Cu: 0 to 2.0%

Cu improves corrosion resistance, and also has an effect that improves high temperature strength in a medium temperature region by precipitation of so-called ε-Cu that is precipitation of Cu dissolved in the matrix. Therefore, Cu may be contained as necessary. However, if the content of Cu is excessive, it will cause a decrease in toughness and a reduction in ductility due to hardening of the steel sheet. Therefore, the content of Cu is set to 2.0% or less. In addition, in consideration of oxidation resistance and producibility, the content of Cu is preferably less than 1.5%. On the other hand, to obtain the aforementioned effects, the content of Cu is preferably 0.1% or more.

Zr: 0 to 0.30%

Zr is an element that improves oxidation resistance, and may be contained as necessary. However, if the content of Zr is more than 0.30%, Zr will cause a marked deterioration in producibility such as pickling properties and toughness. Further, it will cause coarsening of compounds of Zr with carbon and nitrogen. As a result, grain coarsening of the steel sheet microstructure will be caused during hot-rolling and annealing, causing the r-value to decrease. Therefore, the content of Zr is set to 0.30% or less. In addition, in consideration of the production cost, the content of Zr is preferably 0.20% or less. On the other hand, to obtain the aforementioned effect, the content of Zr is preferably 0.05% or more.

Co: 0 to 0.50%

Co is an element that improves high temperature strength, and may be contained as necessary. However, if the content of Co is excessive, Co will cause the toughness and workability to decrease. Therefore, the content of Co is set to 0.50% or less. In addition, in consideration of the production cost, the content of Co is preferably 0.30% or less. On the other hand, to obtain the aforementioned effect, the content of Co is preferably 0.05% or more.

Sb: 0 to 0.50%

Sb segregates at grain boundaries and increases the high temperature strength, and therefore may be contained as necessary. However, if the content of Sb is more than 0.50%, excessive segregation will occur, and the low-temperature toughness of pipe weld zones will be reduced. Therefore, the content of Sb is set to 0.50% or less. In addition, in consideration of high-temperature characteristics, production cost and toughness, the content of Sb is preferably 0.30% or less. On the other hand, to obtain the aforementioned effect, the content of Sb is preferably 0.01% or more.

REM: 0 to 0.05%

REM (rare earth metal) has an effect that refines various kinds of precipitates and improves toughness and oxidation resistance. Therefore, REM may be contained as necessary. However, if the content of REM is more than 0.05%, castability will markedly decrease. Therefore, the content of REM is set to 0.05% or less. On the other hand, to obtain the aforementioned effect, the content of REM is preferably 0.001% or more. Note that, in consideration of the refining cost and producibility, the content of REM is more preferably 0.003% or more, and preferably is 0.01% or less.

In this regard, the term "REM" is a collective term for 17 elements that include the 15 lanthanoid elements and Y and Sc. One or more of these 17 elements may be contained in the steel material, and the term "content of REM" means the sum of the contents of such elements.

D Group Elements

Ni: 0 to 2.0%

Ni is an element that improves toughness and corrosion resistance, and therefore may be contained as necessary. However, if the content of Ni is more than 2.0%, austenite phase will form and development of texture with a {111} orientation will be inhibited, and the r-value will decrease. Furthermore, pipe bendability will markedly deteriorate. Therefore, the content of Ni is set to 2.0% or less. In addition, in consideration of the production cost, the content of Ni is preferably 0.5% or less. On the other hand, to obtain the aforementioned effect, the content of Ni is preferably 0.1% or more.

Ca: 0 to 0.0030%

Ca is an effective element as a desulfurizing element, and hence may be contained as necessary. However, if the content of Ca is more than 0.0030%, coarse CaS will form and will cause the toughness and corrosion resistance to deteriorate. Therefore, the content of Ca is set to 0.0030% or less. On the other hand, to obtain the aforementioned effect, the content of Ca is preferably 0.0001% or more. Note that, in consideration of the refining cost and producibility, the content of Ca is more preferably 0.0003% or more, and preferably is 0.0020% or less.

Ta: 0 to 0.10%

Ta combines with C and N and contributes to improving toughness, and hence may be contained as necessary. However, if the content of Ta is more than 0.10%, the production cost will increase, and in addition the producibility will markedly decrease. Therefore, the content of Ta is set to 0.10% or less. On the other hand, to obtain the aforementioned effect, the content of Ta is preferably 0.01% or more. Note that, in consideration of the refining cost and producibility, the content of Ta is more preferably 0.02% or more, and preferably is 0.08% or less.

Ga: 0 to 0.1%

Ga improves corrosion resistance and suppresses hydrogen embrittlement, and hence may be contained as necessary. The content of Ga is set to 0.1% or less. On the other hand, to obtain the actions, taking into consideration the formation of sulfides and hydrides, the content of Ga is preferably 0.0002% or more. Note that, from the viewpoint of production cost and producibility as well as ductility and toughness, the content of Ga is more preferably 0.0005% or more, and preferably is 0.020% or less.

The balance in the chemical composition of the steel material of the present invention is Fe and unavoidable impurities. Here, the term "unavoidable impurities" refers to components which, during industrial production of the steel material, are mixed in from a raw material such as ore or scrap or during the production processes due to various causes, and which are allowed within a range that does not adversely affect the present invention.

2. Grain Size Number

The grain size number of the ferritic stainless steel sheet according to the present invention is set as 6.0 or more, and preferably is 6.5 or more. This is because if the grain size number of the steel sheet is less than 6.0, it will be a cause of surface roughness such as orange peel. On the other hand, because it is necessary to cause grains to grow sufficiently in order to cause {111}<112> texture to develop, the grain size number of the steel sheet is preferably 9.0 or less.

With respect to the grain size number, measurement was performed by performing observation by optical microscope in conformance with JIS G 0511.

3. Sheet Thickness

The sheet thickness of the ferritic stainless steel sheet according to the present invention is set to 1.0 mm or more. The sheet thickness of the ferritic stainless steel sheet is preferably 1.2 mm or more, and more preferably is 1.5 mm or more. On the other hand, when producing a thick steel sheet having a large thickness, although it is necessary to make a hot-rolled sheet thick in order to secure adequate rolling reduction, it is difficult from an industrial aspect and from the aspect of toughness to make the hot-rolled sheet extremely thick. Therefore, the thickness of the steel sheet is preferably 3.0 mm or less, and more preferably is 2.5 mm or less.

4. Crystal Orientation Intensity 4-1. Relation Between Crystal Orientation Intensity and Sheet Thickness In the ferritic stainless steel sheet according to the present invention, the relation between the crystal orientation intensities and the sheet thickness satisfies formulas (i) to (iii) described hereunder.

$$A+B \geq 12.0/t \quad \text{(i)}$$

$$X+Y \geq 12.0/(t-0.3) \quad \text{(ii)}$$

$$(X+Y)-(A+B) \leq 5.0 \quad \text{(iii)}$$

where, each symbol in the above formulas (i) to (iii) is defined hereunder.

t: sheet thickness (mm)

A: a {111}<112> crystal orientation intensity at a center portion of sheet thickness B: a {111}<112> crystal orientation intensity at a ¼ portion of the sheet thickness X: a {322}<236> crystal orientation intensity at a center portion of sheet thickness Y: a {322}<236> crystal orientation intensity at a ¼ portion of the sheet thickness.

When texture with a {111}<112> orientation develops, mainly the values of $r_0$ and $r_{90}$, increase, and workability including deep drawability becomes favorable. Therefore, in the steel sheet according to the present invention, it is necessary that the sum of the {111}<112> crystal orientation intensities at a center portion of sheet thickness and a ¼ portion of the sheet thickness (hereinafter, described simply as "sum of the {111}<112> crystal orientation intensities") satisfies the formula (i).

Similarly, when texture with a {322}<236> orientation develops, mainly the values of $r_{45}$ and $r_{90}$ increase, and workability including deep drawability becomes favorable. Therefore, in the steel sheet according to the present invention, it is necessary that the sum of the {322}<236> crystal orientation intensities at a center portion of sheet thickness and a ¼ portion of the sheet thickness (hereinafter, described simply as "sum of the {322}<236> crystal orientation intensities") satisfies the formula (ii).

In this regard, if texture with a {322}<236> orientation is caused to develop too strongly, in some cases the development of texture with a {111}<112> orientation will be inhibited, and conversely the workability will decrease. Therefore, it is necessary that the difference between the sum of the {322}<236> crystal orientation intensities and the sum of the {111}<112> crystal orientation intensities satisfies the formula (iii).

Note that, when evaluating the texture in the steel sheet according to the present invention, measurement was also performed with respect to the crystal orientation intensity at a ¼ portion of the sheet thickness, and not just the crystal orientation intensity at a center portion of sheet thickness that is generally measured. The reason for also performing the measurement was to check the influence of shear deformation which influences formation of recrystallized microstructure and which is particularly liable to occur at a ¼ portion of the sheet thickness from the sheet surface during cold rolling of a steel sheet.

Measurement of the texture was performed by obtaining (200), (110) and (211) pole figures of the sheet-thickness central region (exposing the central region by a combination of mechanical polishing and electropolishing) using an X-ray diffractometer (manufactured by Rigaku Corporation) and Mo-Kα ray, to obtain an ODF (Orientation Distribution Function) using spherical harmonics based on the pole figures. The {111}<112> crystal orientation intensity and the {322}<236> crystal orientation intensity were calculated based on the measurement results. Note that, in the present invention, crystal orientation intensities of the ferrite phase that is the matrix are measured.

4-2. Relation Between Each r-Value and Sheet Thickness

With regard to the r-values of the steel sheet according to the present invention, r-values for a direction parallel to the rolling direction and a 45° direction and a 90° direction with respect to the rolling direction were determined for a test specimen by executing the method described below in accordance with JIS Z 2254, and thereafter a mean r-value was calculated.

In this case, the r-value is calculated by the following method. Specifically, JIS No. 13B tensile test pieces are taken from a cold-rolled annealed sheet at locations parallel to the rolling direction, and in a 45° direction and a 90° direction with respect to the rolling direction, and after applying strain of 10 to 20% thereto, the respective values are substituted into formula (a) below to calculate r-values. Further, a mean r-value (hereunder, described as "$r_m$") is calculated using formula (iv) below.

$$r=\ln(W_0/W)/\ln(T_0/T) \quad \text{(a)}$$

where, each symbol in the above formula is defined hereunder.

$W_0$: sheet width before tensile test

W: sheet width after tensile test $T_0$: sheet thickness before tensile test

T: sheet thickness after tensile test $$r_m=(r_0+2r_{45}+r_{90})/4 \quad \text{(iv)}$$

where, each symbol in the above formula is defined hereunder.

$r_0$: r-value in the rolling direction $r_{45}$: r-value in a 45° direction with respect to the rolling direction $r_{90}$: r-value in a 90° direction with respect to the rolling direction Further, the term "minimum r-value" (hereunder, described as "$r_{min}$") is the r-value that is smallest among the measured values $r_0$, $r_{45}$ and $r_{90}$ described above.

In this case, the formability of the steel sheet according to the present invention was evaluated by performing a cylindrical deep drawing test. The relation between $r_m$ and sheet thickness in a case where formability was evaluated under the conditions described hereunder in a deep drawing forming state with a forming limiting drawing ratio of 2.20 is illustrated in FIG. 1. In FIG. 1, a case where forming could be performed without a problem is indicated by the symbol "○", and a case where necking occurred in the vicinity of the punch shoulder part or a case where forming crackings occurred in the course of the forming process is indicated by the symbol "●".

The forming conditions were as follows: punch diameter: Φ50 mm, punch shoulder R: 5 mm, die: ϕ52 mm, die shoulder R: 5 mm, blank diameter: Φ100 mm, blank holder force: 10 kN, lubricant: kinematic viscosity of 1200 $mm^2/s$ at 40° C., and drawing ratio: 2.20 (blank diameter: ϕ110 mm).

Based on FIG. 1, it was found that in order to obtain favorable formability, $r_m$ preferably satisfies formula (v) below.

$$r_m \geq 2.0/t \quad \text{(v)}$$

where, the symbol in the above formula is defined hereunder.

t: sheet thickness (mm)

Figure 2:
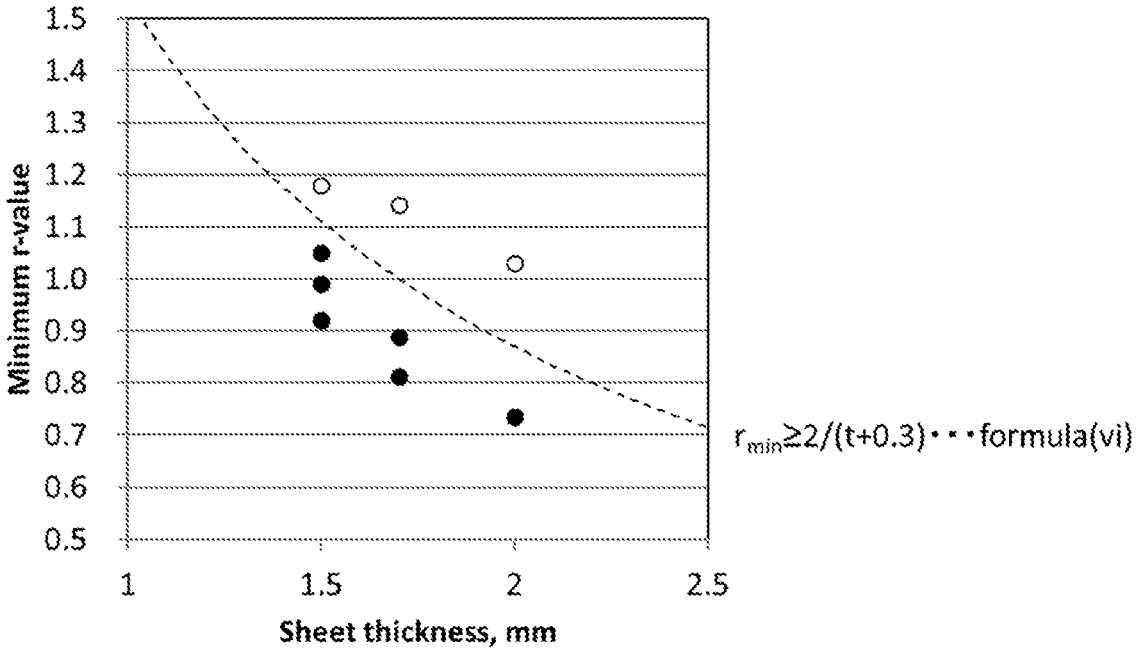
FIG. 2 is a view illustrating the relation between the sheet thickness and the minimum r-value of steel sheets.

Further, the relation between $r_{min}$ and sheet thickness in a case where formability was evaluated under the same conditions is illustrated in FIG. 2. Similarly to FIG. 1, a case where forming could be performed without a problem is indicated by the symbol "○", and a case where necking occurred in the vicinity of the punch shoulder part or a case where forming crackings occurred in the course of the forming process is indicated by the symbol "●".

Based on FIG. 2, it was found that a steel sheet is excellent in formability in a case where $r_{min}$ satisfies formula (vi) below.

$$r_{min} \geq 2.0/(t+0.3) \quad \text{(vi)}$$

where, the symbol in the above formula is defined hereunder.

t: sheet thickness (mm)

4-3. Relation Between Crystal Orientation Intensity and Sheet Thickness

A {111}<112> orientation is a crystal orientation which undergoes slip deformation when strain in the sheet width direction is large in comparison to strain in the thickness direction. Therefore, when the {111}<112> crystal orientation intensity increases, a decrease in sheet thickness is suppressed. As a result, $r_m$ increases. Accordingly, it is necessary for texture with a {111}<112> orientation to develop through the entire thickness of the steel sheet.

Further, when a {322}<236> crystal orientation intensity increases, it changes the anisotropy of the r-value of the steel sheet, and although the value of $r_0$ decreases, the values of $r_{45}$ and $r_{90}$ increase instead. As shown in the formula (v), the contribution of $r_{45}$ to $r_m$ is large, and in order to increase $r_{45}$ that is difficult to increase by simply causing {111}<112> texture to develop, it is effective to cause texture with a {322}<236> orientation to increase.

However, if texture with a {322}<236> orientation is caused to develop too strongly, the development of texture with a {111}<112> orientation will be inhibited, and conversely the value of $r_m$ will decrease. Therefore, by satisfying the formulas (i) to (iii), $r_m$ that satisfies the formula (v) and $r_{min}$ that satisfies the formula (vi) can be obtained.

In consideration of the circumstances described above, in the steel sheet according to the present invention, the crystal orientation intensities with respect to the {111}<112> orientation and the {322}<236> orientation are made values that satisfy the formulas (i) to (iii). Consequently, $r_m$ that satisfies the formula (v) and $r_{min}$ that satisfies the formula (vi) can be attained at the same time.

5. Production Method

Next, the production method will be described. The method for producing the steel sheet of the present invention includes, for example, processes of steelmaking, hot rolling, pickling, cold rolling and annealing. For the steelmaking, a method in which steel having the chemical composition described above is melted in a converter and thereafter subjected to secondary refining is suitable. The thus-melted molten steel is formed into a slab according to a known casting method (continuous casting).

5-1. Hot Rolling Process

Next, the slab is heated to a temperature described hereunder, and is hot-rolled to have a predetermined thickness through a continuous rolling procedure. The cast slab is preferably heated to a temperature in the range of 1100 to 1250° C. This is because, if the heating temperature of the slab is set to less than 1100° C., scale generation will decrease because the heating temperature is too low, and roll scoring will occur between the rolling roll and the steel material, which will cause the surface quality to decrease and will adversely affect the following processes.

On the other hand, setting the heating temperature of the slab to more than 1250° C. is not preferable since sagging of the slab will occur in which the slab will undergo high temperature deformation under its own weight. In addition, taking into consideration productivity and surface defects, the heating temperature of the slab is preferably within the range of 1150 to 1200° C. Note that, in the present invention, the term "heating temperature of the slab" has the same meaning as the term "hot rolling starting temperature".

After heating the slab, in the hot rolling process, a plurality of passes of rough rolling are performed, unidirectional finish rolling is performed using a plurality of stands, and the product is coiled in a coil shape.

5-2. Pickling Process

In the present invention, the hot-rolled steel sheet is subjected to a pickling treatment without performing hot-rolled-sheet annealing, and is then subjected to a cold rolling process as a cold rolling starting material. This process is different from a typical production method in which a hot-rolled steel sheet is usually subjected to hot-rolled-sheet annealing to obtain a granulated recrystallization microstructure. Typically, although performing hot-rolled-sheet annealing facilitates microstructure control, hot rolling strain disappears and development of the {111} crystal orientation is hindered, and in addition, the {322}<236> crystal orientation that increases $r_{90}$ does not develop in an annealing process after the subsequent cold rolling. Note that, among grains with the {111} orientation, a grain with a {111}<112> orientation may be mentioned as a representative grain.

In this connection, when a steel sheet in which texture referred to as "α-fiber" ({011}//RD({100} to {111}<011>)) developed is annealed, the {322}<236> crystal orientation develops more strongly. In a ferritic stainless steel sheet, the α-fiber develops by hot rolling and cold rolling. However, when hot-rolled-sheet annealing is performed, the α-fiber that developed during hot rolling disappears temporarily before cold rolling, and randomization of the crystal orientation progresses. Therefore, in the present invention, hot-rolled-sheet annealing is not performed.

5-3. Cold Rolling Process

In the cold rolling process, a roll with a diameter of 400 mm or more is used, on which cold rolling is performed with a rolling reduction of 60% or more. In this case, by adopting a roll diameter of 400 mm or more, shear strain during cold rolling can be suppressed. Since shear deformation introduced due to shear strain becomes a nucleation site of randomly oriented grains, it is necessary to suppress shear strain. As a result, in the following annealing process, formation of grains with a {111}<112> crystal orientation that increase the r-value is promoted. By this means, a {111}<112> crystal orientation is also caused to develop at a ¼ portion of the sheet thickness that is a location at which it is usually difficult for a {111}<112> crystal orientation to develop.

Further, when the rolling reduction increases, accumulated energy that serves as a driving force for recrystallization increases. As a result, nuclei of the {111}<112> crystal orientation are likely to be preferentially formed, and it becomes easy for the {111}<112> crystal orientation to be selectively grown. Therefore, the rolling reduction in the cold rolling is set to 60% or more, and more preferably is 70% or more.

5-4. Annealing Process after Cold Rolling

In order to cause a {111}<112> texture to develop and improve the workability, it is preferable to strictly control the annealing temperature and heating rate based on the recrystallization behavior during annealing.

5-4-1. Annealing Temperature

With regard to the final annealing after cold rolling, it is necessary to perform annealing at a sufficiently high temperature for {111}<112> recrystallized grain development. At the same time, annealing at an excessively high temperature leads to coarsening of the grains, and is a cause of surface roughness such as orange peel. Further, it is necessary to make the steel microstructure of the steel sheet according to the present invention a fine microstructure with a grain size number of 6.0 or more. Therefore, preferably annealing is performed at an annealing temperature Tf (° C.) within the range of formula (vii) described hereunder:

$$800 \leq Tf(° C.) \leq 950 \quad \text{(vii)}$$

5-4-2. Heating Rate

For the steel sheet according to the present invention, it is preferable to control the average heating rate for the time period from the starting temperature of heating until the target temperature is reached. Among recrystallized grains, grains with a {111}<112> orientation are liable to form at a relatively early stage of recrystallization in comparison to grains with other orientations. Further, grains with a {111}<112> orientation undergo grain growth during annealing and develop by encroaching on grains with other orientations. At such time, before recrystallization of {111} orientation starts, if the temperature rises to a temperature at which grains with other orientations recrystallize, development of texture with a {111}<112> orientation will be suppressed and the workability will decrease. Therefore, it is preferable to cause recrystallization to proceed by first causing the steel sheet temperature to reach the starting temperature of recrystallization Ts (° C.) by rapid heating, and thereafter slowly increasing the temperature until the annealing temperature Tf (° C.) to thereby cause grains with a {111}<112> orientation to grow. By this means, texture with a {111}<112> orientation strongly develops in the steel sheet.

Note that, Ts (° C.) at such time is shown by the following formula (viii) which takes into account the influence that the rolling reduction in the cold rolling process has on recrystallization:

$$Ts(° C.) = 700 + (1 - X/100) \times 130 \quad \text{(viii)}$$

where, the symbol in the above formula is defined below.

X: rolling reduction in cold rolling (%)

For the steel sheet according to the present invention, the average heating rate from the starting temperature of heating to the starting temperature of recrystallization Ts (° C.) is preferably 15° C./s or more, and more preferably is 20° C./s or more.

Further, the average heating rate from the starting temperature of recrystallization Ts (° C.) to the annealing temperature Tf (° C.) is preferably 10° C./s or less, and more preferably is 5° C./s or less. Further, by rolling with a large-diameter roll that has a diameter of 400 mm or more as described above, introduction of shear deformation is suppressed in comparison to a usual production method. As a result, formation of randomly oriented grains due to shear deformation is suppressed, and this is combined with an effect of nucleation of grains with a {111}<112> orientation at an early stage so that {111}<112> orientation strongly develops in comparison to the usual production method (rolling with a small-diameter roll and without heat treatment control).

Furthermore, by adopting the aforementioned production conditions in addition to omitting hot-rolled-sheet annealing as described above, texture with a {322}<236> orientation and texture with a {111}<112> orientation develop simultaneously. Thus, the ferritic stainless steel sheet according to the present invention can be obtained.

5-5. Other Production Conditions

The slab thickness and hot-rolled sheet thickness and the like may be designed as appropriate. Further, the degree of roll roughness, rolling oil, number of rolling passes, rolling speed, rolling temperature and the like in the cold rolling may be designed as appropriate. With respect to annealing, as necessary, bright annealing which is annealing in a non-oxidizing atmosphere such as hydrogen gas or nitrogen gas may be performed. Further, annealing may be performed in the atmospheric air. In addition, after annealing, a tension leveler process for temper rolling or shape straightening may be performed, or the sheet may be passed through.

5-6. Method for Producing Ferritic Stainless Member

The following method is used to make a steel sheet produced by the method described above into members for exhaust components. These members are press worked from the steel sheet or are formed into a target shape after the steel sheet is made into a pipe of a predetermined size (diameter).

Hereunder, the present invention is described more specifically by way of examples, although the present invention is not limited to these examples.

Example 1

Steels having the chemical compositions shown in Table 1 were melted, cast into slabs, and hot-rolled under conditions of a slab heating temperature of 1150° C. and a coiling temperature of 500° C. to make hot-rolled steel sheets.

TABLE 1

| | Steel type No. | Chemical Composition (mass %, balance is Fe and impurities) | | | | | | | | | | | |
|---|---|---|---|---|---|---|---|---|---|---|---|---|---|
| | | | | | | | | | | A group | B group | | |
| | | C | Si | Mn | P | S | Cr | Ti | N | Nb | Sn | Mg | B |
| Inventive Examples | A1 | 0.002 | 0.10 | 0.05 | 0.032 | 0.004 | 13.3 | 0.12 | 0.014 | — | — | — | — |
| | A2 | 0.018 | 0.32 | 0.10 | 0.029 | 0.004 | 13.5 | 0.15 | 0.015 | — | — | — | — |
| | A3 | 0.005 | 0.03 | 0.80 | 0.034 | 0.005 | 14.1 | 0.14 | 0.012 | — | — | — | — |
| | A4 | 0.011 | 1.44 | 0.81 | 0.023 | 0.003 | 18.2 | 0.22 | 0.008 | — | — | — | 0.0005 |
| | A5 | 0.009 | 0.91 | 0.03 | 0.019 | 0.002 | 19.1 | 0.13 | 0.010 | — | — | — | — |
| | A6 | 0.009 | 0.43 | 1.48 | 0.021 | 0.001 | 13.0 | 0.09 | 0.011 | — | — | — | — |
| | A7 | 0.007 | 0.35 | 0.12 | 0.045 | 0.003 | 15.1 | 0.11 | 0.016 | — | — | — | — |
| | A8 | 0.006 | 0.89 | 1.24 | 0.033 | 0.009 | 17.2 | 0.13 | 0.013 | — | — | — | — |
| | A9 | 0.006 | 0.22 | 0.05 | 0.042 | 0.002 | 11.2 | 0.21 | 0.012 | — | 0.152 | — | — |
| | A10 | 0.005 | 0.30 | 0.13 | 0.026 | 0.004 | 24.1 | 0.13 | 0.017 | — | — | — | — |
| | A11 | 0.004 | 0.12 | 0.42 | 0.027 | 0.003 | 16.9 | 0.02 | 0.011 | — | — | — | — |
| | A12 | 0.005 | 0.19 | 0.34 | 0.028 | 0.002 | 17.7 | 0.28 | 0.014 | — | — | — | 0.0009 |
| | A13 | 0.012 | 0.27 | 0.42 | 0.018 | 0.005 | 13.1 | 0.09 | 0.003 | — | — | — | — |
| | A14 | 0.009 | 0.26 | 0.53 | 0.019 | 0.003 | 18.2 | 0.17 | 0.027 | — | — | — | 0.0005 |
| | A15 | 0.010 | 0.40 | 0.30 | 0.024 | 0.002 | 16.9 | 0.23 | 0.008 | — | — | — | — |
| | A16 | 0.006 | 0.07 | 0.03 | 0.028 | 0.001 | 16.9 | 0.20 | 0.012 | — | — | — | — |
| | A17 | 0.007 | 0.10 | 0.10 | 0.025 | 0.001 | 17.6 | 0.16 | 0.011 | 0.095 | — | 0.0091 | — |
| | A18 | 0.012 | 0.51 | 0.33 | 0.033 | 0.008 | 17.9 | 0.27 | 0.019 | — | 0.421 | — | 0.0041 |

TABLE 1-continued

| | | | | | | | | | | | | | |
|---|---|---|---|---|---|---|---|---|---|---|---|---|---|
| | A19 | 0.006 | 0.41 | 0.28 | 0.029 | 0.004 | 14.3 | 0.16 | 0.012 | — | — | — | — |
| | A20 | 0.008 | 0.39 | 0.38 | 0.022 | 0.005 | 16.5 | 0.17 | 0.013 | — | — | — | — |
| Comparative Examples | a1 | 0.031 * | 0.51 | 0.43 | 0.031 | 0.006 | 14.4 | 0.12 | 0.013 | — | — | — | — |
| | a2 | 0.005 | 0.01 * | 0.34 | 0.042 | 0.007 | 13.9 | 0.13 | 0.014 | — | — | — | — |
| | a3 | 0.006 | 0.42 | 1.65 * | 0.019 | 0.008 | 12.8 | 0.11 | 0.010 | — | — | — | — |
| | a4 | 0.005 | 0.30 | 0.82 | 0.069 * | 0.004 | 13.1 | 0.10 | 0.011 | — | — | — | — |
| | a5 | 0.012 | 0.45 | 1.31 | 0.023 | 0.022 * | 13.0 | 0.21 | 0.011 | — | 0.110 | — | — |
| | a6 | 0.006 | 0.09 | 0.71 | 0.015 | 0.005 | 27.3 * | 0.12 | 0.020 | — | — | — | — |
| | a7 | 0.006 | 0.06 | 0.44 | 0.028 | 0.008 | 17.6 | — * | 0.011 | — | — | — | — |
| | a8 | 0.013 | 0.48 | 0.39 | 0.034 | 0.006 | 11.5 | 0.19 | 0.038 * | 0.005 * | — | — | — |
| | a9 | 0.011 | 0.49 | 0.50 | 0.024 | 0.005 | 12.7 | 0.15 | 0.022 | 1.12 * | — | — | — |

| | Steel type | Chemical Composition (mass %, balance is Fe and impurities) | | | | | | | | | | | | |
|---|---|---|---|---|---|---|---|---|---|---|---|---|---|---|
| | | B group | | | C group | | | | | | D group | | | |
| | No. | V | Mo | W | Al | Cu | Zr | Co | Sb | REM | Ni | Ca | Ta | Ga |
| Inventive Examples | A1 | — | — | — | — | — | — | — | — | — | — | — | — | — |
| | A2 | — | — | — | — | — | — | — | — | — | — | — | — | — |
| | A3 | — | — | — | — | — | — | — | — | — | — | — | — | — |
| | A4 | — | — | — | — | — | — | — | — | — | — | — | — | — |
| | A5 | — | — | — | — | — | — | — | — | — | — | — | — | — |
| | A6 | — | — | — | — | — | — | — | — | — | — | — | — | — |
| | A7 | — | — | — | — | — | — | — | — | — | — | — | 0.09 | 0.0920 |
| | A8 | — | — | — | — | — | — | — | — | — | — | — | — | — |
| | A9 | — | — | — | — | — | — | — | — | — | — | — | — | — |
| | A10 | — | 1.19 | — | — | — | — | — | — | — | — | — | — | — |
| | A11 | — | — | — | 0.481 | — | — | — | — | 0.021 | — | — | — | — |
| | A12 | — | — | — | — | — | — | — | — | — | — | — | — | — |
| | A13 | — | — | — | — | — | — | — | — | — | — | — | — | — |
| | A14 | — | 2.59 | — | — | 1.8 | — | — | — | — | 1.88 | — | — | — |
| | A15 | — | — | — | — | — | — | — | — | — | — | — | — | — |
| | A16 | — | — | — | 0.086 | — | — | — | — | — | 0.11 | — | — | — |
| | A17 | — | — | 2.88 | — | 0.5 | — | — | — | — | — | — | — | — |
| | A18 | — | 1.80 | — | — | — | — | — | — | 0.048 | — | — | — | — |
| | A19 | 0.890 | — | — | — | — | 0.28 | — | — | — | — | 0.0028 | — | — |
| | A20 | — | — | — | — | — | — | 0.48 | 0.47 | — | — | — | — | — |
| Comparative Examples | a1 | — | — | — | — | — | — | — | — | — | — | — | — | — |
| | a2 | — | — | — | — | — | — | — | — | — | — | — | — | — |
| | a3 | — | — | — | — | — | — | — | — | — | — | — | — | — |
| | a4 | — | — | — | — | — | — | — | — | — | — | — | — | — |
| | a5 | — | — | — | — | — | — | — | — | — | — | — | — | — |
| | a6 | — | 1.20 | — | — | — | — | — | — | — | 0.72 | — | — | — |
| | a7 | — | — | — | — | — | — | — | — | — | — | — | — | — |
| | a8 | — | — | — | — | 0.8 | — | — | — | — | — | — | — | — |
| | a9 | — | — | — | — | — | — | — | — | — | — | — | — | — |

* Indicates value is outside range defined by the present invention.

Thereafter, the respective hot-rolled steel sheets that had been pickled were cold-rolled to the thickness shown in Table 2 using a roll with a diameter within the range of 400 to 500 mm, and continuous annealing and pickling were performed. The cold-rolled annealed sheets obtained in this way were subjected to r-value measurement as well as crystal orientation intensity measurement.

With regard to the r-value, after executing the method described above in accordance with JIS Z 2254, and taking test specimens from a direction parallel to the rolling direction and a 45° direction and a 90° direction with respect to the rolling direction and determining the r-values, a mean r-value was calculated. Specifically, JIS No. 13B tensile test pieces were taken, and after applying strain of 10 to 20% in a direction parallel to the rolling direction and a 45° direction and a 90° direction with respect to the rolling direction, the values were calculated by a prescribed method.

With regard to the crystal orientation intensity measurement, (200), (110) and (211) pole figures of the sheet-thickness central region (exposing the central region by a combination of mechanical polishing and electropolishing) were obtained using an X-ray diffractometer (manufactured by Rigaku Corporation) and Mo-Kα ray, and an ODF (Orientation Distribution Function) was obtained using spherical harmonics based on the pole figures. The {111}<011> crystal orientation intensity and the {322}<236> crystal orientation intensity were calculated based on the measurement results. Note that, in the present invention, crystal orientation intensities of the ferrite phase that is the matrix were measured.

Further, the formability was evaluated by means of a cylindrical deep drawing test. The forming conditions were as follows. Specifically, the conditions were: punch diameter: Φ50 mm, punch shoulder R: 5 mm, die: ϕ52 mm, die shoulder R: 5 mm, blank diameter: Φ100 mm, blank holder force: 10 kN, lubricant: kinematic viscosity of 1200 $mm^2/s$ at 40° C., and drawing ratio: 2.20 (blank diameter: ϕ110 mm).

The formability was evaluated based on the deep drawing forming state with a forming limiting drawing ratio of 2.20 under the aforementioned conditions. In Table 2, a case where forming could be performed is indicated by the symbol "○", a case where necking occurred in the vicinity of the punch shoulder part is indicated by the symbol "Δ", and a case where forming crackings occurred in the course of the forming process is indicated by the symbol "x". These evaluation results are shown collectively in Table 2.

TABLE 2

| | Symbol | Steel type No. | Sheet Thickness t (mm) | Crystal Orientation Intensity: Formula (i) A + B | Formula (i) 12.0/t | Formula (ii) X + Y | Formula (ii) 12.0/(t − 0.3) | Formula (iii) (X + Y) − (A + B) | r-value: Formula (iv) $r_m$ | Formula (v) 2.0/t | Formula (vi) $r_{min}$ | Formula (vi) 2.0/(t + 0.3) | Workability |
|---|---|---|---|---|---|---|---|---|---|---|---|---|---|
| Inventive Examples | B1 | A1 | 1.0 | 19.3 | 12.0 | 24.1 | 17.1 | 4.8 | 2.14 | 2.00 | 1.78 | 1.54 | ○ |
| | B2 | A2 | 1.5 | 10.3 | 8.0 | 13.4 | 10.0 | 3.1 | 1.42 | 1.33 | 1.22 | 1.11 | ○ |
| | B3 | A3 | 1.2 | 12.4 | 10.0 | 15.5 | 13.3 | 3.1 | 1.79 | 1.67 | 1.40 | 1.33 | ○ |
| | B4 | A4 | 1.6 | 8.5 | 7.5 | 13.4 | 9.2 | 4.9 | 1.41 | 1.25 | 1.13 | 1.05 | ○ |
| | B5 | A5 | 1.5 | 8.9 | 8.0 | 13.6 | 10.0 | 4.7 | 1.50 | 1.33 | 1.27 | 1.11 | ○ |
| | B6 | A6 | 1.5 | 8.7 | 8.0 | 12.3 | 10.0 | 3.6 | 1.43 | 1.33 | 1.21 | 1.11 | ○ |
| | B7 | A7 | 1.5 | 9.3 | 8.0 | 13.5 | 10.0 | 4.2 | 1.48 | 1.33 | 1.25 | 1.11 | ○ |
| | B8 | A8 | 1.7 | 8.8 | 7.1 | 13.0 | 8.6 | 4.2 | 1.33 | 1.18 | 1.09 | 1.00 | ○ |
| | B9 | A9 | 1.5 | 8.9 | 8.0 | 13.7 | 10.0 | 4.8 | 1.46 | 1.33 | 1.20 | 1.11 | ○ |
| | B10 | A10 | 1.2 | 13.6 | 10.0 | 17.6 | 13.3 | 4.0 | 1.83 | 1.67 | 1.41 | 1.33 | ○ |
| | B11 | A11 | 1.5 | 10.4 | 8.0 | 14.4 | 10.0 | 4.0 | 1.54 | 1.33 | 1.22 | 1.11 | ○ |
| | B12 | A12 | 2.0 | 8.9 | 6.0 | 12.3 | 7.1 | 3.4 | 1.47 | 1.00 | 1.03 | 0.87 | ○ |
| | B13 | A13 | 1.8 | 8.1 | 6.7 | 10.2 | 8.0 | 2.1 | 1.25 | 1.11 | 1.01 | 0.95 | ○ |
| | B14 | A14 | 1.7 | 8.3 | 7.1 | 11.5 | 8.6 | 3.2 | 1.33 | 1.18 | 1.12 | 1.00 | ○ |
| | B15 | A15 | 1.2 | 16.7 | 10.0 | 19.0 | 13.3 | 2.3 | 1.81 | 1.67 | 1.39 | 1.33 | ○ |
| | B16 | A16 | 1.7 | 9.1 | 7.1 | 10.2 | 8.6 | 1.1 | 1.49 | 1.18 | 1.14 | 1.00 | ○ |
| | B17 | A17 | 1.2 | 12.8 | 10.0 | 16.1 | 13.3 | 3.3 | 1.75 | 1.67 | 1.45 | 1.33 | ○ |
| | B18 | A18 | 1.5 | 9.2 | 8.0 | 14.1 | 10.0 | 4.9 | 1.42 | 1.33 | 1.19 | 1.11 | ○ |
| | B19 | A19 | 1.5 | 8.5 | 8.0 | 11.7 | 10.0 | 3.2 | 1.39 | 1.33 | 1.18 | 1.11 | ○ |
| | B20 | A20 | 1.5 | 9.4 | 8.0 | 12.5 | 10.0 | 3.1 | 1.51 | 1.33 | 1.23 | 1.11 | ○ |
| Comparative Examples | b1 | a1 * | 1.5 | 7.2 * | 8.0 | 9.6 * | 10.0 | 2.4 | 1.23 ** | 1.33 | 1.02 ** | 1.11 | x |
| | b2 | a2 * | 1.5 | 6.5 * | 8.0 | 8.8 * | 10.0 | 2.3 | 1.18 ** | 1.33 | 0.99 ** | 1.11 | Δ |
| | b3 | a3 * | 1.2 | 9.1 * | 10.0 | 12.5 * | 13.3 | 3.4 | 1.47 ** | 1.67 | 1.12 ** | 1.33 | x |
| | b4 | a4 * | 1.5 | 7.0 * | 8.0 | 9.4 * | 10.0 | 2.4 | 1.15 ** | 1.33 | 1.03 ** | 1.11 | x |
| | b5 | a5 * | 1.0 | 10.4 * | 12.0 | 16.2 * | 17.1 | 5.8 * | 1.62 ** | 2.00 | 1.28 ** | 1.54 | x |
| | b6 | a6 * | 1.5 | 7.0 * | 8.0 | 9.3 * | 10.0 | 2.3 | 1.21 ** | 1.33 | 1.06 ** | 1.11 | Δ |
| | b7 | a7 * | 2.0 | 5.1 * | 6.0 | 6.4 * | 7.1 | 1.3 | 0.95 ** | 1.00 | 0.81 ** | 0.87 | x |
| | b8 | a8 * | 1.2 | 7.2 * | 10.0 | 11.1 * | 13.3 | 3.9 | 1.32 ** | 1.67 | 1.24 ** | 1.33 | x |
| | b9 | a9 * | 1.5 | 6.4 * | 8.0 | 11.2 * | 10.0 | 4.8 | 1.20 ** | 1.33 | 0.95 ** | 1.11 | x |

* Indicates item is outside range defined by the present invention.

** Indicates value is outside preferable range in the present invention.

As described above, the production methods of the examples shown in Table 2 each use a production method that is within a favorable range of the present invention. Further, Inventive Examples B1 to B20 of the present invention that used steels (Steel Nos. A1 to A20 in Table 1) having a chemical composition defined by the present invention satisfied the conditions defined by the present invention, and were each excellent in workability. In contrast, in Comparative Examples b1 to b9 that used steels (Steel Nos. a1 to a9 in Table 1) having a composition outside the range defined by the present invention, the crystal orientation intensities (textures) of the ferrite phase defined by the present invention were low, and because the mean r-value was low, these Comparative Examples b1 to b9 were inferior in workability.

Example 2

Table 3 shows the characteristics in a case where the steel types described in Table 1 were produced under the production conditions shown in Table 3. Evaluation of the formability was performed using a cylindrical deep drawing test according to the same conditions as in Example 1.

In Table 3 also, similarly to Table 2, a case where forming could be performed is indicated by the symbol "○", a case where necking occurred in the vicinity of the punch shoulder part is indicated by the symbol "Δ", and a case where forming crackings occurred in the course of the forming process is indicated by the symbol "x".

TABLE 3

| | Symbol | Steel No. | Sheet Thickness t (mm) | Hot-Rolled-Sheet Annealing: Holding Temperature (° C.) | Cold Rolling: Roll Diameter (mm) | Cold Rolling: Rolling Reduction (%) | Cold-Rolled-Sheet Annealing: Heating Rate: Until Ts (° C./s) | Heating Rate: Ts~Tf (° C./s) | Recrystallization Starting Temperature: Formula (viii) (° C.) | Recrystallization Starting Temperature: Ts (° C.) | Annealing Temperature Formula (vii) Tf (° C.) |
|---|---|---|---|---|---|---|---|---|---|---|---|
| Inventive Examples | C1 | A12 | 2.0 | — | 500 | 70 | 18 | 4 | 739 | 739 | 870 |
| | C2 | A16 | 1.7 | — | 500 | 66 | 20 | 5 | 744 | 744 | 870 |
| | C3 | A19 | 1.5 | — | 400 | 65 | 20 | 5 | 746 | 746 | 870 |

TABLE 3-continued

| | | | | | | | | | | | |
|---|---|---|---|---|---|---|---|---|---|---|---|
| Comparative Examples | c1 | A16 | 1.7 | 950 | 500 | 66 | 20 | 5 | 744 | 744 | 870 |
| | c2 | A12 | 2.0 | — | 105 | 66 | 18 | 4 | 744 | 744 | 900 |
| | c3 | A16 | 1.7 | — | 400 | 55 | 20 | 5 | 759 | 759 | 870 |
| | c4 | A19 | 1.5 | — | 500 | 65 | 7 | 5 | 746 | 746 | 890 |
| | c5 | A19 | 1.5 | — | 500 | 65 | 20 | 20 | 746 | 746 | 890 |
| | c6 | A19 | 1.5 | — | 500 | 65 | 20 | 5 | 746 | 600 | 890 |

| | | Characteristics Evaluation | | | | | | | | | |
|---|---|---|---|---|---|---|---|---|---|---|---|
| | | Crystal Orientation Intensity | | | | | r-value | | | | |
| | | Formula (i) | | Formula (ii) | | Formula (iii) | Formula (iv) | Formula (v) | Formula (vi) | | |
| | Symbol | A + B | 12.0/t | X + Y | 12.0/ (t − 0.3) | (X + Y) − (A + B) | $r_m$ | 2.0/t | $r_{min}$ | 2.0/ (t + 0.3) | Workability |
| Inventive Examples | C1 | 8.9 | 6.0 | 12.3 | 7.1 | 3.4 | 1.47 | 1.00 | 1.03 | 0.87 | ○ |
| | C2 | 9.1 | 7.1 | 10.2 | 8.6 | 1.1 | 1.49 | 1.18 | 1.14 | 1.00 | ○ |
| | C3 | 8.5 | 8.0 | 11.7 | 10.0 | 3.2 | 1.39 | 1.33 | 1.18 | 1.11 | ○ |
| Comparative Examples | c1 | 7.5 | 7.1 | 5.8 * | 8.6 | −1.7 | 1.20 | 1.18 | 0.89 ** | 1.00 | x |
| | c2 | 5.7 * | 6.0 | 11.4 | 71 | 5.7 * | 0.93 ** | 1.00 | 0.73 ** | 0.87 | Δ |
| | c3 | 6.1 * | 7.1 | 8.1 * | 8.6 | 2.0 | 1.10 ** | 1.18 | 0.81 ** | 1.00 | x |
| | c4 | 6.8 * | 8.0 | 8.9 * | 10.0 | 2.1 | 1.23 ** | 1.33 | 1.05 ** | 1.11 | x |
| | c5 | 7.2 * | 8.0 | 10.8 | 10.0 | 3.6 | 1.08 ** | 1.33 | 0.99 ** | 1.11 | Δ |
| | c6 | 6.5 * | 8.0 | 8.8 * | 10.0 | 2.3 | 1.04 ** | 1.33 | 0.92 ** | 1.11 | x |

* Indicates value is outside range defined by the present invention.
** Indicates value is outside preferable range in the present invention.
Underline indicates value deviates from preferable production conditions of the present invention.

In Inventive Examples C1 to C3 of the present invention shown in Table 3, the composition was within the range defined by the present invention, and the production conditions satisfied the preferable conditions in the present invention, and therefore favorable r-values and favorable workability were obtained. In contrast, in Comparative Examples c1 to c6, the production conditions deviated from the preferable conditions in the present invention. Therefore, the crystal orientation intensities of the steel sheets of Comparative Examples c1 to c6 were outside the defined ranges of the present invention, and adequate values for $r_m$ and $r_{min}$ in accordance with the sheet thickness were not obtained and the workability was not good.

The invention claimed is:

1. A ferritic stainless steel sheet, comprising a chemical composition consisting of, in mass %, C: 0.001 to 0.020%,
Si: 0.02 to 1.50%,
Mn: 0.02 to 1.50%,
P: 0.01 to 0.05%,
S: 0.0001 to 0.01%,
Cr: 10.0 to 25.0%,
Ti: 0.01 to 0.30%,
N: 0.001 to 0.030%,
Nb: 0 to less than 0.10%,
Sn: 0 to 0.500%,
Mg: 0 to 0.0100%,
B: 0 to 0.0050%,
V: 0 to 1.0%,
Mo: 0 to 3.0%,
W: 0 to 3.0%,
Al: 0 to 0.5%,
Cu: 0 to 2.0%,
Zr: 0 to 0.30%,
Co: 0 to 0.50%,
Sb: 0 to 0.50%,
REM: 0 to 0.05%,
Ni: 0 to 2.0%,
Ca: 0 to 0.0030%,
Ta: 0 to 0.10%,
Ga: 0 to 0.1%, and
the balance: Fe and unavoidable impurities,
wherein:
a grain size number is 6.0 or more,
the ferritic stainless steel sheet satisfies formula (i), formula (ii) and formula (iii) described hereunder with respect to crystal orientation intensities of a ferrite phase obtained by X-ray diffraction,
and a sheet thickness is 1.0 mm or more;

$$A+B \geq 12.0/t \quad \text{(i)}$$

$$X+Y \geq 12.0/(t-0.3) \quad \text{(ii)}$$

$$(X+Y)-(A+B) \leq 5.0 \quad \text{(iii)}$$

where, each symbol in the above formulas is defined as follows:
t: sheet thickness in mm
A: a {111}<112> crystal orientation intensity at a center portion of sheet thickness
B: a {111}<112> crystal orientation intensity at a ¼ portion of the sheet thickness
X: a {322}<236> crystal orientation intensity at a center portion of sheet thickness
Y: a {322}<236> crystal orientation intensity at a ¼ portion of the sheet thickness.

2. The ferritic stainless steel sheet according to claim 1, wherein a mean r-value calculated by formula (iv) described hereunder and a minimum r-value satisfy formula (v) and formula (vi) described hereunder:

$$r_m = (r_0 + 2r_{45} + r_{90})/4 \quad \text{(iv)}$$

$$r_m \geq 2.0/t \quad \text{(v)}$$

$$r_{min} \geq 2.0/(t+0.3) \quad \text{(vi)}$$

where, each symbol in the above formulas is defined as follows:

$r_m$: mean r-value $r_{min}$: minimum r-value t: sheet thickness in mm $r_0$: r-value in a rolling direction $r_{45}$: r-value in 45° direction with respect to the rolling direction $r_{90}$: r-value in 90° direction with respect to the rolling direction.

3. The ferritic stainless steel sheet according to claim 1, wherein the chemical composition has, in mass %, one or more elements selected from:

Nb: more than 0.005% to less than 0.10%,
Sn: 0.01 to 0.500%,
Mg: 0.0002 to 0.0100%,
B: 0.0002 to 0.0050%,
V: 0.05 to 1.0%,
Mo: 0.2 to 3.0%,
W: 0.1 to 3.0%,
Al: 0.003 to 0.5%,
Cu: 0.1 to 2.0%,
Zr: 0.05 to 0.30%,
Co: 0.05 to 0.50%,
Sb: 0.01 to 0.50%,
REM: 0.001 to 0.05%,
Ni: 0.1 to 2.0%,
Ca: 0.0001 to 0.0030%,
Ta: 0.01 to 0.10%, and
Ga: 0.0002 to 0.1%.

4. The ferritic stainless steel sheet according to claim 1, wherein the ferritic stainless steel sheet is used for an exhaust system component.

5. A ferritic stainless member for an exhaust system component of an automobile or a motorcycle, comprising the ferritic stainless steel sheet according to claim 1.

6. The ferritic stainless steel sheet according to claim 2, wherein the chemical composition has, in mass %, one or more elements selected from:

Nb: more than 0.005% to less than 0.10%,
Sn: 0.01 to 0.500%,
Mg: 0.0002 to 0.0100%,
B: 0.0002 to 0.0050%,
V: 0.05 to 1.0%,
Mo: 0.2 to 3.0%,
W: 0.1 to 3.0%,
Al: 0.003 to 0.5%,
Cu: 0.1 to 2.0%,
Zr: 0.05 to 0.30%,
Co: 0.05 to 0.50%,
Sb: 0.01 to 0.50%,
REM: 0.001 to 0.05%,
Ni: 0.1 to 2.0%,
Ca: 0.0001 to 0.0030%,
Ta: 0.01 to 0.10%, and
Ga: 0.0002 to 0.1%.

7. The ferritic stainless steel sheet according to claim 2, wherein the ferritic stainless steel sheet is used for an exhaust system component.

8. A ferritic stainless member for an exhaust system component of an automobile or a motorcycle, comprising the ferritic stainless steel sheet according to claim 2.

9. The ferritic stainless steel sheet according to claim 3, wherein the ferritic stainless steel sheet is used for an exhaust system component.

10. A ferritic stainless member for an exhaust system component of an automobile or a motorcycle, comprising the ferritic stainless steel sheet according to claim 3.

11. The ferritic stainless steel sheet according to claim 6, wherein the ferritic stainless steel sheet is used for an exhaust system component.

12. A ferritic stainless member for an exhaust system component of an automobile or a motorcycle, comprising the ferritic stainless steel sheet according to claim 6.

13. A method for producing the ferritic stainless steel sheet according to claim 1, comprising executing in sequence:

(a) a process of heating a slab having a chemical composition, and hot-rolling the slab to form a hot-rolled steel sheet;

(b) a hot-rolled steel sheet pickling process of pickling the hot-rolled steel sheet without subjecting the hot-rolled steel sheet to annealing, to obtain a pickled steel sheet;

(c) a cold rolling process of using a rolling mill having a roll diameter of 400 mm or more to subject the pickled steel sheet to cold rolling with a rolling reduction of 60% or more to obtain a cold-rolled steel sheet; and (d) a process of annealing the cold-rolled steel sheet at an annealing temperature Tf (° C.) that satisfies formula (vii) described hereunder;

wherein:

in the process of (d), an average heating rate until reaching the annealing temperature Tf (° C.) is:

set to 15° C./s or more in a temperature region from a starting temperature of heating to a starting temperature of recrystallization Ts (° C.) calculated by formula (viii) described hereunder, and set to 10° C./s or less in a temperature region from the starting temperature of recrystallization Ts (° C.) to the annealing temperature Tf (° C.);

$$800 \leq Tf(^\circ\,C.) \leq 950 \quad \text{(vii)}$$

$$Ts(^\circ\,C.) = 700 + (1 - X/100) \times 130 \quad \text{(viii)}$$

where, a symbol in the above formula is defined as follows:

X: rolling reduction in cold rolling (%);

wherein the chemical composition of the slab consists of, in mass %,

C: 0.001 to 0.020%,
Si: 0.02 to 1.50%,
Mn: 0.02 to 1.50%,
P: 0.01 to 0.05%,
S: 0.0001 to 0.01%,
Cr: 10.0 to 25.0%,
Ti: 0.01 to 0.30%,
N: 0.001 to 0.030%,
Nb: 0 to less than 0.10%,
Sn: 0 to 0.500%,
Mg: 0 to 0.0100%,
B: 0 to 0.0050%,
V: 0 to 1.0%,
Mo: 0 to 3.0%,
W: 0 to 3.0%,
Al: 0 to 0.5%,
Cu: 0 to 2.0%,
Zr: 0 to 0.30%,
Co: 0 to 0.50%,
Sb: 0 to 0.50%,
REM: 0 to 0.05%,
Ni: 0 to 2.0%,
Ca: 0 to 0.0030%, Ta: 0 to 0.10%, Ga: 0 to 0.1%, and the balance: Fe and unavoidable impurities.

14. A method for producing the ferritic stainless steel sheet according to claim 3, comprising executing in sequence:

(a) a process of heating a slab having a chemical composition, and hot-rolling the slab to form a hot-rolled steel sheet;

(b) a hot-rolled steel sheet pickling process of pickling the hot-rolled steel sheet without subjecting the hot-rolled steel sheet to annealing, to obtain a pickled steel sheet;

(c) a cold rolling process of using a rolling mill having a roll diameter of 400 mm or more to subject the pickled steel sheet to cold rolling with a rolling reduction of 60% or more to obtain a cold-rolled steel sheet; and (d) a process of annealing the cold-rolled steel sheet at an annealing temperature Tf (° C.) that satisfies formula (vii) described hereunder;

wherein:

in the process of (d), an average heating rate until reaching the annealing temperature Tf (° C.) is:

set to 15° C./s or more in a temperature region from a starting temperature of heating to a starting temperature of recrystallization Ts (° C.) calculated by formula (viii) described hereunder, and set to 10° C./s or less in a temperature region from the starting temperature of recrystallization Ts (° C.) to the annealing temperature Tf (° C.);

$$800 \leq Tf(^\circ\,C.) \leq 950 \quad \text{(vii)}$$

$$Ts(^\circ\,C.) = 700 + (1 - X/100) \times 130 \quad \text{(viii)}$$

where, a symbol in the above formula is defined as follows:

X: rolling reduction in cold rolling (%);

wherein the chemical composition of the slab consists of, in mass %,

C: 0.001 to 0.020%,

Si: 0.02 to 1.50%,

Mn: 0.02 to 1.50%,

P: 0.01 to 0.05%,

S: 0.0001 to 0.01%,

Cr: 10.0 to 25.0%,

Ti: 0.01 to 0.30%,

N: 0.001 to 0.030%, one or more elements selected from:

Nb: more than 0.005% to less than 0.10%,

Sn: 0.01 to 0.500%,

Mg: 0.0002 to 0.0100%,

B: 0.0002 to 0.0050%,

V: 0.05 to 1.0%,

Mo: 0.2 to 3.0%,

W: 0.1 to 3.0%,

Al: 0.003 to 0.5%,

Cu: 0.1 to 2.0%,

Zr: 0.05 to 0.30%,

Co: 0.05 to 0.50%,

Sb: 0.01 to 0.50%,

REM: 0.001 to 0.05%,

Ni: 0.1 to 2.0%,

Ca: 0.0001 to 0.0030%,

Ta: 0.01 to 0.10%, and

Ga: 0.0002 to 0.1%, and the balance: Fe and unavoidable impurities.

* * * * *